US005399133A

United States Patent [19]

Haber et al.

[11] Patent Number: 5,399,133

[45] Date of Patent: Mar. 21, 1995

[54] APPENDAGE INTERFACE ASSEMBLY FOR EXERCISE MACHINE

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Laguna Hills, Calif.

[21] Appl. No.: 117,480

[22] Filed: Sep. 7, 1993

[51] Int. Cl.[6] ..... A63B 23/16

[52] U.S. Cl. ..... 482/49; 482/45; 482/115; 482/139

[58] Field of Search ..... 482/44, 45, 46, 49, 482/50, 100, 110, 114, 115, 118, 131, 139; 601/33, 40; D21/198, 222

[56] References Cited

U.S. PATENT DOCUMENTS

| | | | |
|---|---|---|---|
| Re. 33,218 | 5/1990 | Twardosz | 482/139 |
| 4,306,714 | 12/1981 | Loomis et al. | 482/131 |
| 4,585,363 | 4/1986 | McGuire | 482/44 |
| 4,629,184 | 12/1986 | Selkee | 482/139 |
| 4,640,508 | 2/1987 | Escher | 482/139 |
| 4,770,409 | 9/1988 | Wallisch | 482/128 |
| 5,013,034 | 5/1991 | March et al. | 482/115 |
| 5,062,633 | 11/1991 | Engel et al. | 482/118 |
| 5,080,350 | 1/1992 | Schofield et al. | 482/131 |
| 5,284,458 | 2/1994 | Perry et al. | 482/49 |

*Primary Examiner*—Richard J. Apley
*Assistant Examiner*—Jeanne M. Mollo
*Attorney, Agent, or Firm*—Townsend & Townsend Khourie & Crew

[57] ABSTRACT

An appendage interface assembly, such as a hand grip assembly (2) or a foot pedal assembly (120), is used with an exercise machine to reduce skeletal misalignment problems while increasing the muscle working benefits of the exercise. The assembly includes an assembly support (4, 122) securable to the exercise machine. A hand grip (22) or foot pedal (128) is pivotally mounted to the assembly support for movement about three orthogonal axes (26, 28, 30; 134, 174, 176). The foot pedal is mounted using a universal or ball joint (130). With the hand grip assembly, a yoke (12) is pivotally mounted to the assembly support, a hand grip support (16) is pivotally mounted to the yoke, and a hand grip (22) is pivotally mounted to the hand grip support by first, second and third pivots (14,18,24) for movement about the three axes. The hand grip or foot pedal can pivot freely or with a drag force hindering the pivotal motion or, if great enough, locking the hand grip or foot pedal to a fixed orientation.

11 Claims, 6 Drawing Sheets

APPENDAGE INTERFACE ASSEMBLY FOR EXERCISE MACHINE

BACKGROUND OF THE INVENTION

Regular exercise is well recognized as important for good health. Some people get enough exercise through their normal work day. Others, especially those having desk jobs, often find that regular exercise must be a planned part of their week to ensure that they get enough exercise. Many people have found that various types of exercise machines, such as rowing machines, stationary running machines, stair climbers and so forth, are very effective at getting a good workout efficiently.

One of the problems with conventional exercise machines is that they often have fixed hand grips. These hand grips have several shortcomings. Because the spatial orientation of the hand grip is fixed relative to the machine, the muscle groups used are often flexed in only a single plane. This tends to overuse certain muscles and under use other muscles because of the restricted nature of the movement. Another problem which has arisen is the incidence of injury to the user, including carpal tunnel syndrome. It is believed that this occurs because the fixed grip units cause the hand and forearm to often be misaligned since the machine is not specially fitted to each individual user. Even if a fixed grip were fitted to a particular user, many, if not most, exercises can cause the hand and forearm to become misaligned over much of the exercise movement. It is believed that this misalignment of the hand and forearm can cause various problems, including carpal tunnel syndrome. Similar problems can arise from foot pedals which are fixed or pivot about only a single axis.

SUMMARY OF THE INVENTION

The present invention is directed to appendage interface assemblies, typically a foot pedal assembly or a hand grip assembly, used with an exercise machine to reduce some of the angular misalignment problems of conventional foot pedals and hand grips while increasing the benefits of the exercise.

The hand grip assembly includes an assembly support securable to the exercise machine. An intermediate support is pivotally mounted to the assembly support, a hand grip support is pivotally mounted to the intermediate support, and a hand grip is pivotally mounted to the hand grip support by first, second and third pivots for movement about first, second and third axes respectively. This arrangement provides a gyroscopic-type hand grip assembly to permit the user to grasp the hand grip and orient the hand grip in virtually any desired spatial orientation; doing can minimize or eliminate any angular misalignment between the hand and forearm. The hand grip assembly preferably provides a hand grip in which the pivots are permitted to pivot freely or to pivot with a drag or retarding force hindering the pivotal motion. The drag or retarding force applied at the pivots preferably can be made sufficiently large to enable the user to selectively lock, for example, the first and second pivots, so to fix the angular orientation of the hand grip when desired.

The foot pedal assembly includes an assembly support securable to the exercise machine, a foot pedal and a pivot assembly which pivotally mounts the foot pedal to the assembly support for pivotal movement about first, second and third axes. The first axis is nominally perpendicular to the foot pedal. The first, second and third axes are preferably orthogonal axes. The pivot assembly is preferably of the ball joint type and has a resilient support member situated between the foot pedal and the pedal support, thus biasing the foot pedal to a normal, at-rest position relative to the second and third axes. The pivot assembly can be constructed to permit limited pivotal movement of the foot pedal about the first axis as well.

One of the primary advantages of the invention is that it permits the hand grip to eliminate or substantially eliminate misalignment between the user's hand and forearm due to its gyroscopic-type support structure. In this way misalignment, which can cause unbalanced and asymmetrical forces, can be minimized or eliminated. In addition, since the hand grip can move as the user's arm moves during an exercise routine, the hand grip automatically assumes the proper spatial orientation to accommodate the position and angle of the user's hand and forearm. This allows the user to move muscles in more than one plane thus exercising the muscles over a wider range of motion. This enriches the exercise regimen and makes the exercise of the muscles more efficient. Since the hand grip assembly can conform to the exact angular deflections of the individual skeletal system, there is less possibility of user injury, such as carpal tunnel syndrome, using the hand grip assembly. Similar advantages accrue through the use of the pedal assembly made according to the invention.

Another advantage of the invention is that by letting the pivots move freely, physical exertion is maximized in a manner similar to using free weights as opposed to exercise machines. For example, when doing single arm curls with a dumb bell, the user not only must use his or her arm muscles to lift the weight but also use the muscles to keep the dumb bell from rotating or turning. Similarly, with the hand grip assembly of the invention, effort must be provided to keep the hand grip appropriately oriented and prevent it from twisting one way or another during the exercise movements. Thus, using the invention helps combine the benefits of exercise machines and free weights in a single exercise procedure.

The hand grip assembly preferably is configured so that at least one of the pivots can have a drag force applied retarding the relative rotation of the components pivotally mounted to one another. In the preferred embodiment this is achieved by providing an adjustable frictional drag to both the first and second pivots so that movement of the hand grip assembly about either the first axis or the second axis can only be done against the drag force exerted through those pivots. This can be used in two ways. First, the drag force can be adjusted so that the user overcomes the drag force and causes the hand grip assembly to pivot about either or both of the first and second pivots thus working the muscles used to overcome the frictional drag force. A second way is to increase the frictional drag force sufficiently to in effect lock the support components to one another to prevent, in the preferred embodiment, rotational movement about either the first axis or the second axis. This permits the hand grip assembly to be custom fit to an individual for proper alignment. This can be especially useful for rehabilitative purposes. For example, the different support members could be locked at different relative angles for each set of the same exercise as well as for each different exercise.

In the preferred embodiment the resistance to pivotal movement of the foot pedal about the second and third axes is created by the resilient support. The stiffness of the resilient support could be adjusted by having a structure which would pre-load or pre-compress the resilient support. For example, the main mounting bolt which is connected to the ball at one end and to the pivotal support at the other could be designed to permit the main mounting bolt to be adjustable in so far as how far it pulls the ball, and thus the pedal, towards the pedal support.

Other features and advantages of this invention will appear from the following description in which the preferred embodiment has been set forth in detail in conjunction with the accompanying drawings.

DESCRIPTION OF THE PREFERRED EMBODIMENT

Figure 1:
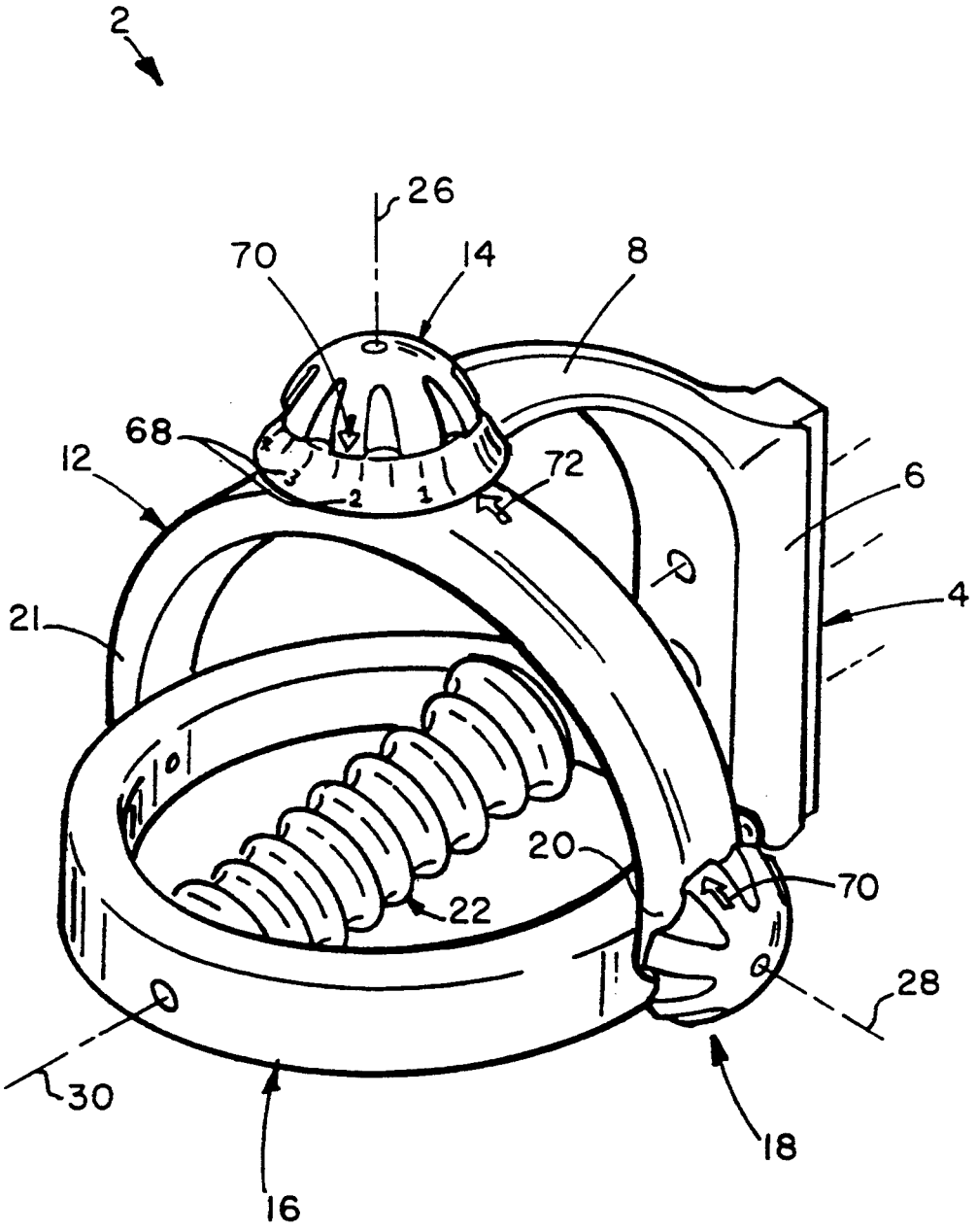
FIG. 1 is an isometric view of a hand grip assembly made according to the invention.
Figure 2:
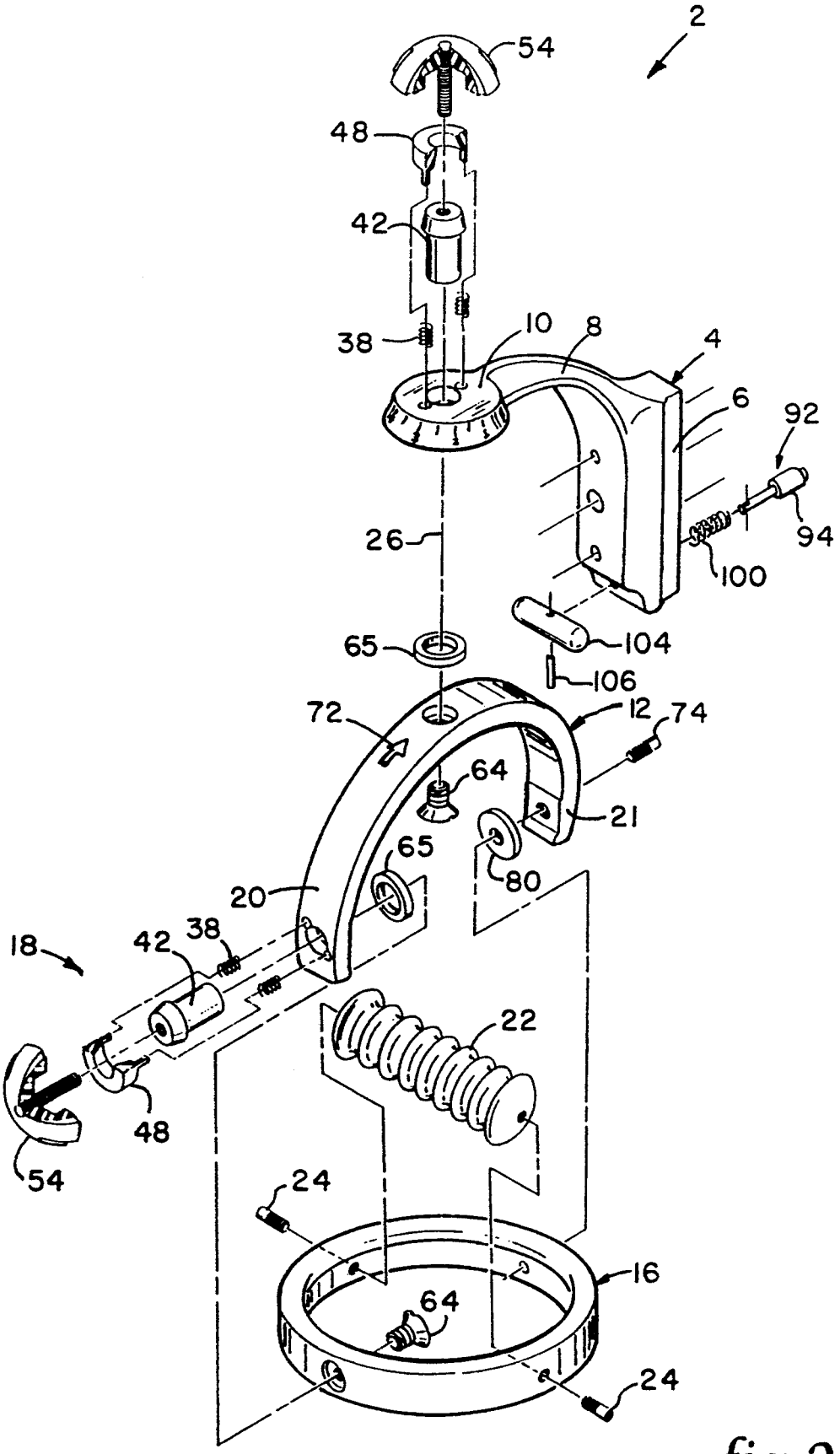
FIG. 2 is an exploded isometric view of the assembly of FIG. 1.
Figure 2A:
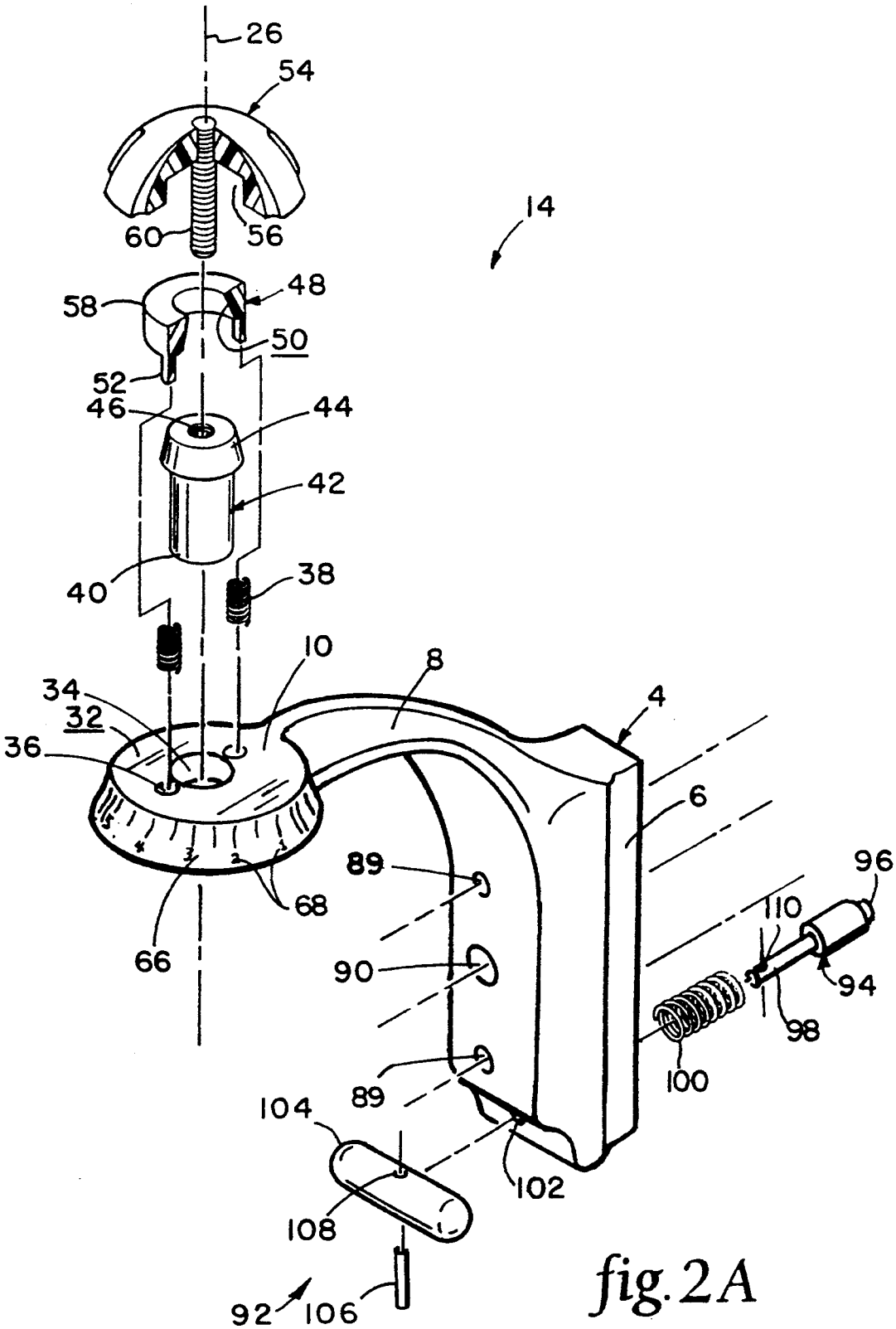
FIG. 2A is an enlarged view of a portion of the components shown in FIG. 2.
Figure 2B:
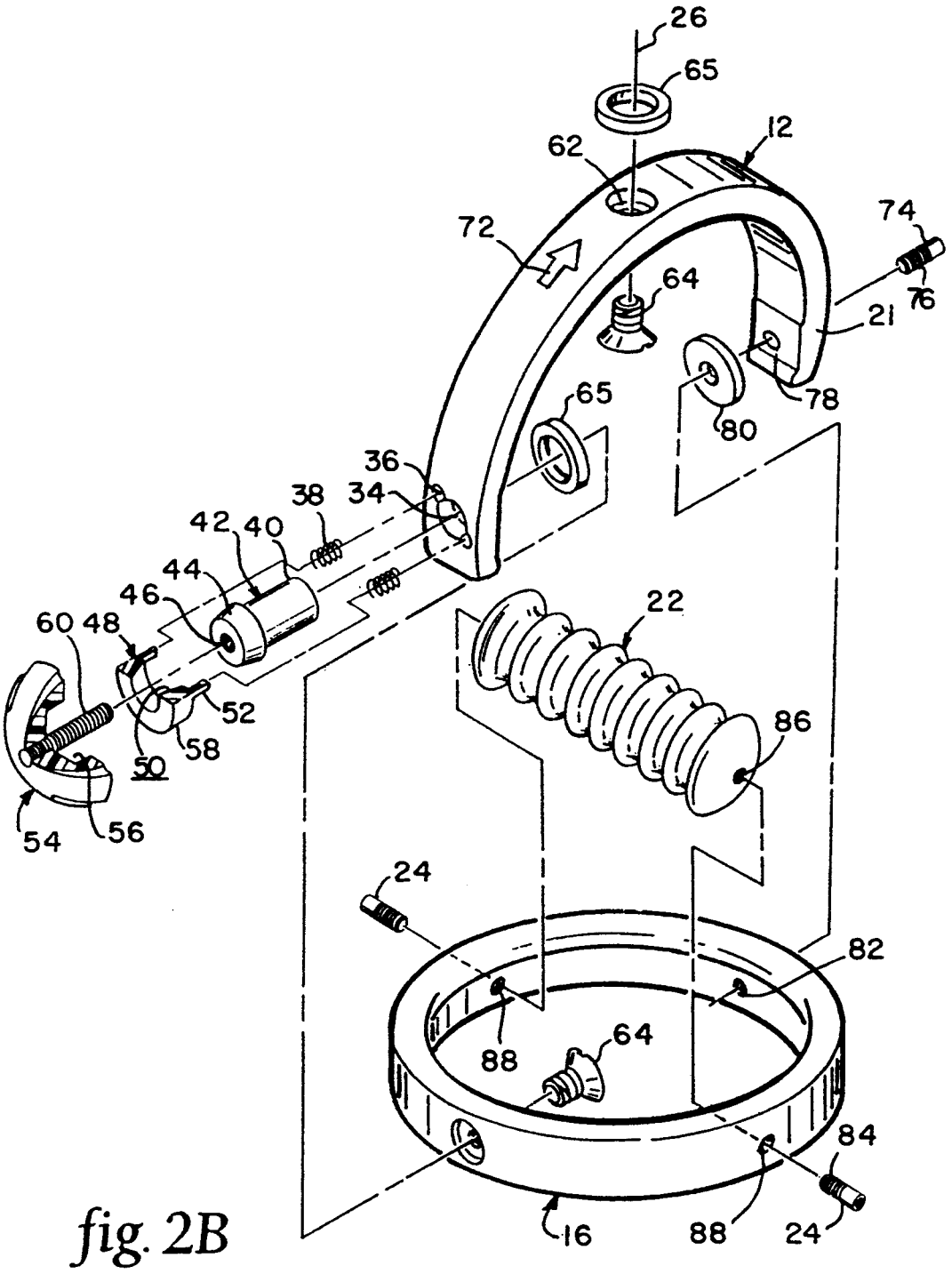
FIG. 2B is an enlarged view of the remaining components shown in FIG. 2.

FIGS. 1–2B illustrate a hand grip assembly 2 designed for use with an exercise machine, not shown. Broadly, assembly 2 includes a generally L-shaped assembly support 4 having a generally vertical base 6 and an outwardly extending, curved arm 8. The outer end 10 of arm 8 is pivotally mounted to a semi-circular yoke 12 by a first pivot 14. Yoke 12 is pivotally supported to a ring-like hand grip support 16 by a second pivot 18 at the outer ends 20, 21 of yoke 12. A hand grip 22 is mounted within hand grip support 16 by a pair of partially threaded pivot pins 24 to permit hand grip 22 to rotate or pivot freely within hand grip support 16. Assembly 2 thus permits hand grip 22 to pivot about a first axis 26 defined by first pivot 14, a second axis 28 defined by second pivot 18 and a third axis 30 defined by pivot pins 24.

FIG. 2A illustrates first pivot 14 and outer end 10 of arm 8 in more detail. Outer end 10 includes an enlarged circular surface 32 having a hole 34 and a pair of bores 36 on either side of hole 34. A pair of brake ring biasing springs 38 are supported by surface 32 and surround bores 36 while the smaller, lower end 40 of a bushing 42 passes through bore 34. Bushing 42 has an enlarged, tapered flange end 44 with a threaded hole 46 passing through bushing 42. A brake ring 48 has an internal tapered surface 50 sized to engage tapered flange end 44 of bushing 42. Brake ring 48 has a pair of pins 52 sized to fit into holes 36 and compress springs 38. Thus, with pins 52 engaged within holes 36, brake ring 48 cannot rotate about first axis 26.

First pivot 14 also includes a tightening knob 54 having a central recess 56 within which the upper end 58 of brake ring 48 is housed. Tightening knob 54 includes a threaded stud 60 secured to and extending downwardly from knob 54 and sized to engage threaded hole 46.

FIG. 2B illustrates yoke 12 with a counter bore 62 formed therein coaxial with first axis 26. A screw 64 extends upwardly through counterbore 62 to engage the threaded lower end of threaded hole 46. A washer 65 is positioned between yoke 12 and outer end 10 of arm 8. Screw 64 and bushing 42 are sized so that when screw 64 fully engaged with the lower end of threaded bore 46 of bushing 42, smaller end 40 of the bushing is seated securely within counter bore 62 to, in effect, lock yoke 12 to bushing 42 so that yoke 12 and bushing 42 rotate together about axis 26. Tightening knob 54 against brake ring 48 causes tapered surface 50 of the brake ring to press against tapered flange end 44 of bushing 42. Since smaller end 40 of bushing 42 is tightly engaged within counter bore 62 by engagement of screw 64, bushing 42 rotates with yoke 12. Since brake ring 48 cannot rotate about axis 26 due to the engagement of pins 52 in holes 36, a drag force is created between yoke 12 and base 6 to the rotation of yoke 12 about first axis 26. Tightening knob 54 even further effectively locks surface 50 against tapered flange end 44 to prevent relative pivotal movement between yoke 12 and base 6.

The outer beveled surface 66 surrounding circular surface 32 at outer end 10 of arm 8 preferably has a number of markings 68 which provide two functions. The first function is to indicate how tight knob 54 is pressing against brake ring 48 thus indicating the amount of drag or retarding force created between surface 50 and flanged end 44. This is indicated by aligning an indicator marking 70 on knob 54 with markings 68 on surface 66. The second function of markings 68 is to provide an indication of the angular relationship between arm 8 and yoke 12. This is provided by aligning a second indicator marking 72 on yoke 12 with markings 68. While in the preferred embodiment only a single set of markings 68 are shown, two sets of markings, one for force and one for angle, could be used as well.

Second pivot 18 is substantially identical to first pivot 14 and thus will not be described separately. In the drawing figures like reference numerals refer to like elements. While a pair of second pivots 18 could be used, for the disclosed embodiment one second pivot 18 is used at one outer end 20 of yoke 12. The other outer end 21 is pivotally coupled to ring-like hand grip support 16 by a partially threaded pivot pin 74 having a threaded end 76 which engages a hole 78 formed in outer end of 21 of yoke 12, through a washer 80 and into a threaded hole 82 in support 16. A like manner, pivot pins 24 have threaded ends 84 which engage threaded holes 86 in hand grip 22 with the unthreaded ends housed within holes 88 formed in hand grip support 16. Accordingly, hand grip 22 is free to pivot about third axis 30 without any significant drag or resistance. However, appropriate drag-creating structure could be used to provide a constant or a variable drag to the rotation of hand grip 22 about third axis 30 if desired.

Hand grip assembly 2 could be used with a variety of exercise machines. The disclosed embodiment has been designed for mounting to a support tube, not shown, which slides over a support rod or shaft (not shown) having a series of alignment holes formed in the support rod. Three holes 89, 90 are formed in base 6 of assembly support 4 are used for mounting assembly 2 to the support tube. A spring latch 92 is used to engage the series of holes formed in the support rod. Spring latch 92 includes a locking pin 94 having a reduced diameter tip 96 size to engage the holes formed in the support rod. Locking pin 94 includes a smaller diameter extension 98 over which a spring 100 is mounted. Extension 98 passes through a hole on 102 formed at the bottom of base 6. The distal end of extension 98 is pinned to a positioning knob 104 by a roll pin 106 which passes through holes 108, 110 formed in positioning knob 104 and extension 98 respectively, extension 98 passing into the interior of positioning knob 104 through hole, not shown. Thus, to adjust the location of hand grip assembly 2 along the support rod of the exercise machine to accommodate different users, the user pulls on positioning knob 104 to disengage tip 96 from one of the holes in the support rod and then releases knob 104 when the proper position is attained.

Once hand grip assembly 2 is properly positioned, the user can begin to exercise while leaving first and second pivots 14, 18 to pivot freely. To apply a frictional drag force to the relative rotation between arm 8 and yoke 12 or between yoke 12 and support 16, first and/or second pivots 14, 18 can be tightened a chosen amount to create the desired drag force. If it desired to lock the position of hand grip 22 in a fixed orientation relative to first axis 26 and/or second axis 28, hand grip 22 can be maneuvered to the proper relative orientation and then first pivot 14 and/or second pivot 18 can be tightened to a locked condition.

The main structural components for hand grip assembly 2, that is base 6, yoke 12 and hand grip support 16, are preferably made of aluminum. Brake ring 48 and bushing 42 are preferably brass since brass is self lubricating and non-glalling. The springs and screws are preferably made of stainless steel while locking pin 94 and roll pin 96 are made of steel. Knobs 54, hand grip 22 and washers 65, 80 can be made of acetal, such as made by DuPont of Wilmington, Del. as Delrin ®. Positioning knob 104 is preferably made of a material which can be brightly colored, such as red; ABS is suitable for this purpose. Of course other materials can be used; the above are just exemplary of those used with the preferred embodiment.

Figure 3:
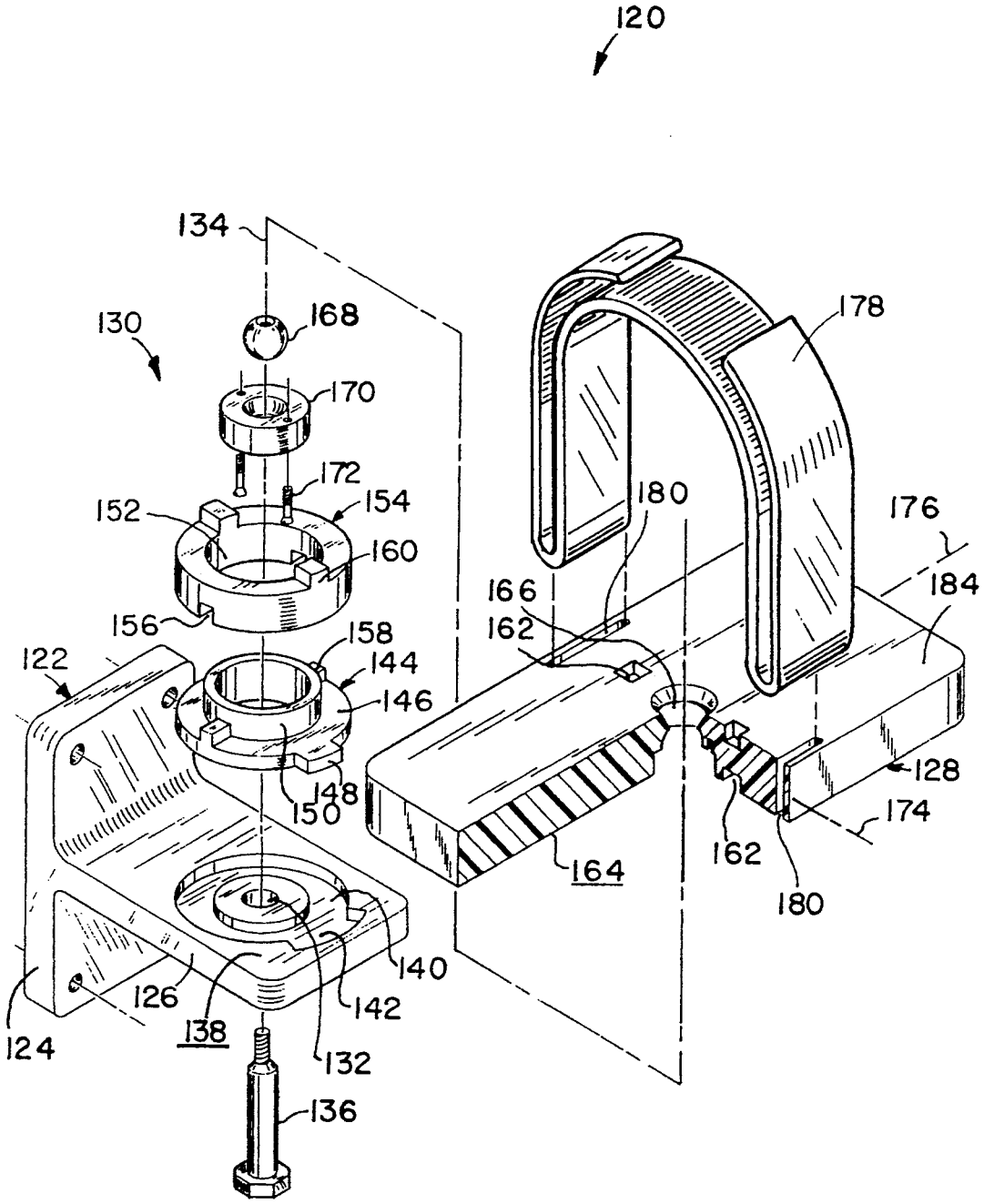
FIG. 3 is an exploded isometric view of a foot pedal assembly made according to the invention.
Figure 4:
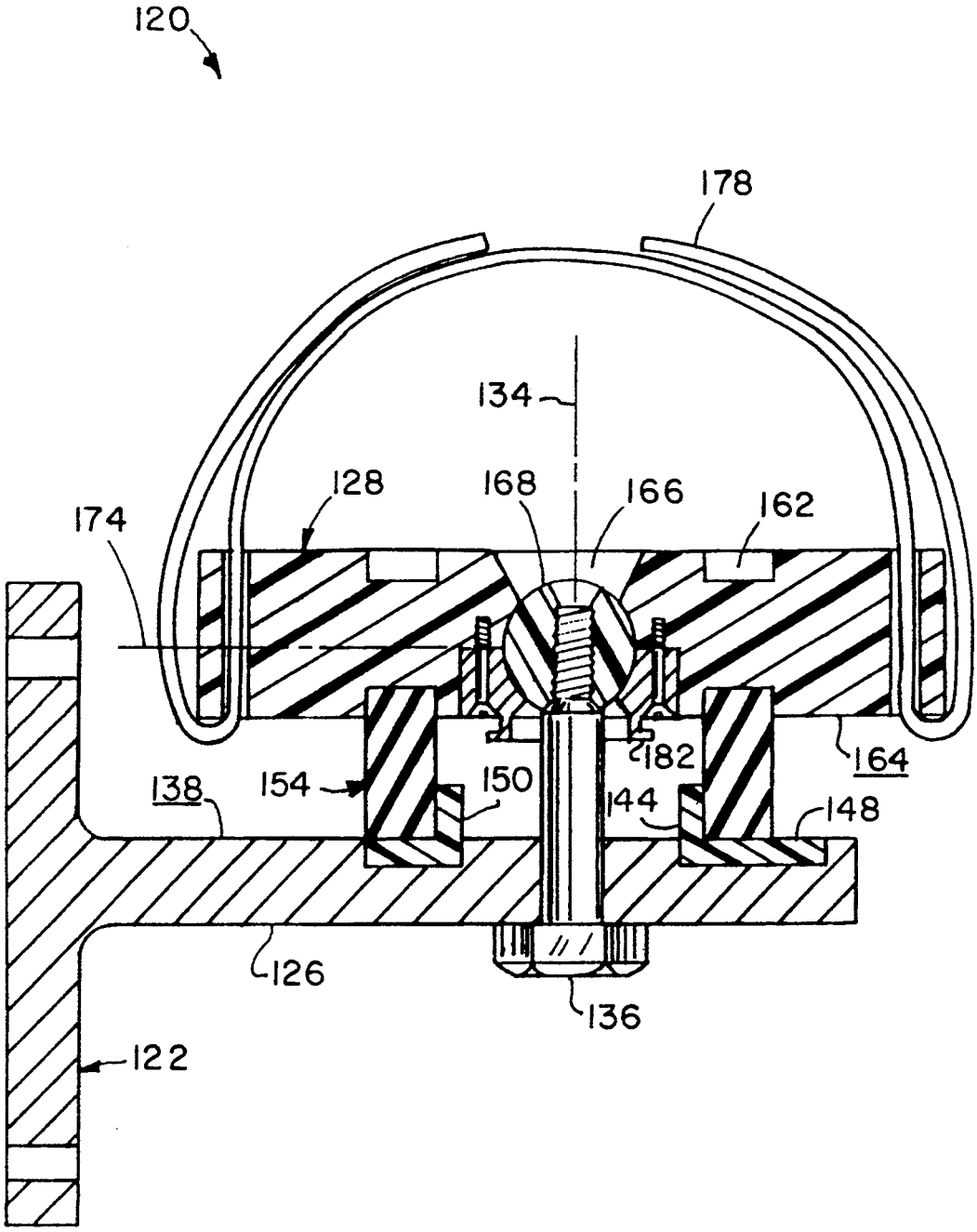
FIG. 4 is a cross-sectional view of the foot pedal assembly of FIG. 3 in an assembled condition with the foot pedal at the foot pedal rest position.

FIGS. 3 and 4 illustrate a foot pedal assembly 120 made according to the invention. Assembly 120 includes a T-shaped assembly support 122, mountable to an exercise machine, having a base 124 and a transversely extending pedal support 126. Assembly 120 also includes a foot pedal 128 which is mounted to pedal support 126 by a pivot assembly 130.

Pedal support 126 has a through hole coaxial with a first axis 134 and through which a main mounting bolt 136 passes. The upper surface 138 of pedal support 126 has a generally annular recess 140 formed therein. Annular recess 140 includes an oversized tab slot 142 along a portion of its periphery.

Pivot assembly 130 includes a limit ring 144 having a lower flange 146 sized to fit within annular recess 140. Flange 146 has an outwardly extending limit tab 148 sized to fit within tab slot 142. Tab slot 142 is oversized in a circumferential dimension relative to limit tab 148 so that limit ring 144 can rotate or pivot about first axis 134 approximately $+15°$ to $-15°$ and preferably about $\pm 10°$.

Limit ring 144 includes a central cylindrical extension 150 which fits within the cylindrical interior 152 of a resilient support 154. Resilient support 154 has a pair of notches 156 sized to accept a pair of complementary lugs 158 extending from lower flange 146 of limit ring 144. This engagement allows resilient support 154 and limit ring 144 to rotate together about first axis 134. Foot pedal 128 is supported by and rests on resilient support 154 as shown in FIG. 4. Resilient support 154 includes a pair of lugs 160 which are housed within complementary openings 162 formed in the lower surface 164 of foot pedal 128.

Foot pedal 128 includes a central opening 166 which houses a ball 168 therein. Ball 168 is secured within central opening 166 by annular ball seat 170. Ball seat 170 is secured within central opening 166 by a pair of screws 172. Opening 166 and ball seat 170 are sized and configured to snugly house ball 168 within central opening 166 but permit foot pedal 128 to be pivoted about ball 168 by the user without excessive resistance. Pivotal movement of foot pedal 128 about second and third axes 174, 176 is resisted by the resilient nature of resilient support 154. Pivotable motion of foot pedal 128 about first axis 134 is resisted primarily by frictional forces. The amount of pivotable movement of foot pedal 128 is limited by the thickness of resilient support 154, the contact of foot support 128 with upper surface 138 of pedal support 126 and the engagement of limit tab 148 with the ends of tab slot 142.

FIGS. 3 and 4 illustrate the use of a Velcro ®-type foot strap 178 which passes through a pair of slots 180 along the lateral edges of pedal 128. Foot pedal 128 can be turned upside-down by disengaging mounting bolt 136 from ball 168, removing foot strap 178, and then resecuring bolt 136 to ball 168 with surface 164 now facing upwardly. Ball seat 170 has a pair of shoe clips 182 extending from surface 164 to permit a user having complementary clips on the user's shoe to secure his or her foot to surface 164 without the use of strap 178. Strap 178 could, of course, be used in addition to clips 182. As is clear from the figures, upper surface 184 of foot pedal 128 also has a pair of openings 162 for receipt of lugs 160 when foot pedal 128 is turned upside-down from the orientation of FIGS. 3 and 4.

In the preferred embodiment, assembly support 122 is made of aluminum, bolt 136 and screws 172 are of stainless steel while annular ball seat 170 is of self-lubricating sintered bronze, such as that sold under the tradename OILLITE. Pivot ring 144, ball 168 and foot pedal 128 are preferably of plastic, such as an acetal resin made by Dupont of Wilmington, Del. as Delrin ®. Resilient support 154 is preferably of elastomeric material such as 35 Durometer silicone rubber. Other materials can also be used as these are simply exemplary.

In use, the user places his or her foot onto surface 164 or surface 184, depending on whether clips 182 are to be used. After adjusting strap 178, if used, user can commence exercising. Pivot assembly 130 permits the user to rotate foot pedal 128 about any of first, second and third axes 134, 174, 176. This helps to prevent misalignment of the user's foot and lower leg as well as helping to enhance the benefits of the exercise to the user.

Modification and variation can be made to the disclosed embodiments without departing from the subject of the invention as defined in the following claims. For example, hand grip 22 could have other shapes and could be made of materials which give somewhat to conform to the particular shape of the hand of the user. Resilient support 154 could be replaced by 3 or more coil springs. Pivot assembly 130 could be constructed so to eliminate resilient support 154 to permit foot pedal 128 to pivot freely about the axes.

What is claimed is:

1. A hand grip assembly for use with an exercise machine comprising:

an assembly support including an exercise machine mounting element;

an intermediate support;

a first pivot pivotally mounting the intermediate support to the assembly support for movement of the intermediate support about a first axis;

a hand grip support;

a second pivot pivotally mounting the hand grip support to the intermediate support for movement of the hand grip support about a second axis;

a hand grip adapted for being grasped by a user;

a third pivot pivotally mounting the hand grip to the hand grip support for movement of the hand grip about a third axis; and the first and second pivots including user adjustable friction drag force means for applying selected frictional drag forces retarding movement of the intermediate support about the first axis relative to the assembly support and retarding movement of the hand grip support about the second axis relative to the intermediate support.

2. The assembly of claim 1 wherein the assembly support is generally L-shaped.

3. The assembly of claim 1 further comprising a visual indicator which provides a visual indication of the level of said retarding force applied between the intermediate support and the assembly support.

4. The assembly of claim 1 further comprising a visual indicator which provides a visual indication of the relative angular orientation of the intermediate support relative to the assembly support.

5. The assembly of claim 1 wherein the drag force applying means is adapted to allow the user to prevent movement of the intermediate support relative to the assembly support and to prevent movement of the hand grip support relative to the intermediate support.

6. The assembly of claim 1 wherein the intermediate support is semi-circular in shape having a central portion and first and second end portions.

7. The assembly of claim 6 wherein said first pivot pivotally mounts the central portion of the intermediate support to the assembly support and including one said second pivot at each of said first and second end portions.

8. The assembly of claim 1 wherein the hand grip support is generally ring-shaped.

9. The assembly of claim 8 wherein the hand grip is mounted within the ring-shaped hand grip support by the third pivot.

10. The assembly of claim 1 wherein the first and second axes are perpendicular and the second and third axes are perpendicular.

11. A hand grip assembly for use with an exercise machine comprising:

an assembly support including an exercise machine mounting element;

an intermediate support;

a first pivot pivotally mounting the intermediate support to the assembly support for movement of the intermediate support about a first axis;

a hand grip support;

a second pivot pivotally mounting the hand grip support to the intermediate support for movement of the hand grip support about a second axis;

a hand grip adapted for being grasped by a user;

a third pivot pivotally mounting the hand grip to the hand grip support for movement of the hand grip about a third axis;

the first and second pivots including means for applying a retarding force to the movement of the intermediate support about the first axis relative to the assembly support and to the movement of the hand grip support about the second axis relates to the intermediate support; and a visual indicator which provides a visual indication of the level of said retarding forces applied to at least one of the first and second pivots.

* * * * *